United States Patent [19]

Grimshaw et al.

[11] 4,274,177

[45] Jun. 23, 1981

[54] CARDING

[75] Inventors: Keith Grimshaw, Todmorden; Roy Taylor, Oldham, both of England

[73] Assignee: The English Card Clothing Company Limited, West Yorkshire, England

[21] Appl. No.: 48,376

[22] Filed: Jun. 14, 1979

Related U.S. Application Data

[63] Continuation of Ser. No. 869,297, Jan. 13, 1978, abandoned.

[30] Foreign Application Priority Data

Jan. 21, 1977 [GB] United Kingdom ..... 2431/77

[51] Int. Cl.[3] ..... D01G 15/02; D01G 15/40

[52] U.S. Cl. ..... 19/99; 19/105

[58] Field of Search ..... 19/99, 100, 101, 102, 19/105, 106 R, 84

[56] References Cited

U.S. PATENT DOCUMENTS

| | | | |
|---|---|---|---|
| 47,976 | 5/1865 | Parkhurst | 19/105 X |
| 562,610 | 6/1896 | Hogg | 19/105 |
| 619,979 | 2/1899 | Morel | 19/84 |
| 2,086,308 | 7/1937 | Van Hille et al. | 19/105 |
| 2,181,535 | 11/1939 | Schlipp et al. | 19/102 |
| 2,415,757 | 2/1947 | Peschel | 19/99 |
| 2,908,046 | 10/1959 | Ohnishi | 19/99 |
| 3,418,697 | 12/1968 | Groce et al. | 19/105 |
| 3,562,862 | 2/1971 | Walker et al. | 19/84 |

FOREIGN PATENT DOCUMENTS

| | | | |
|---|---|---|---|
| 971830 | 10/1964 | United Kingdom | 19/107 |

*Primary Examiner*—Louis Rimrodt

*Attorney, Agent, or Firm*—Norris & Bateman

[57] ABSTRACT

A method and apparatus wherein a machine for carding cotton, man-made fibres and mixtures thereof is provided with a trash removing device usually in the form of a longitudinally fluted roller that cooperates mechanically with a roller clothed with flat-topped card-clothing. The flat-topped clothing roller may be a taker-in roller located in a feed section and the fluted roller is set close to the flat-topped card-clothed roller whereby it is adapted to remove trash projecting above the teeth on the flat-topped card-clothed roller. The trash removing roller is provided with a cowling spaced radially from the periphery of the roller and providing a longitudinally extending gap part way around the roller. A radial lip extends along the one edge of the cowling substantially closing the gap. A deflector lip projects into the gap so as to deflect material travelling in the space between the trash removing roller and the cowling out through the gap.

22 Claims, 10 Drawing Figures

CARDING

Figure 1:
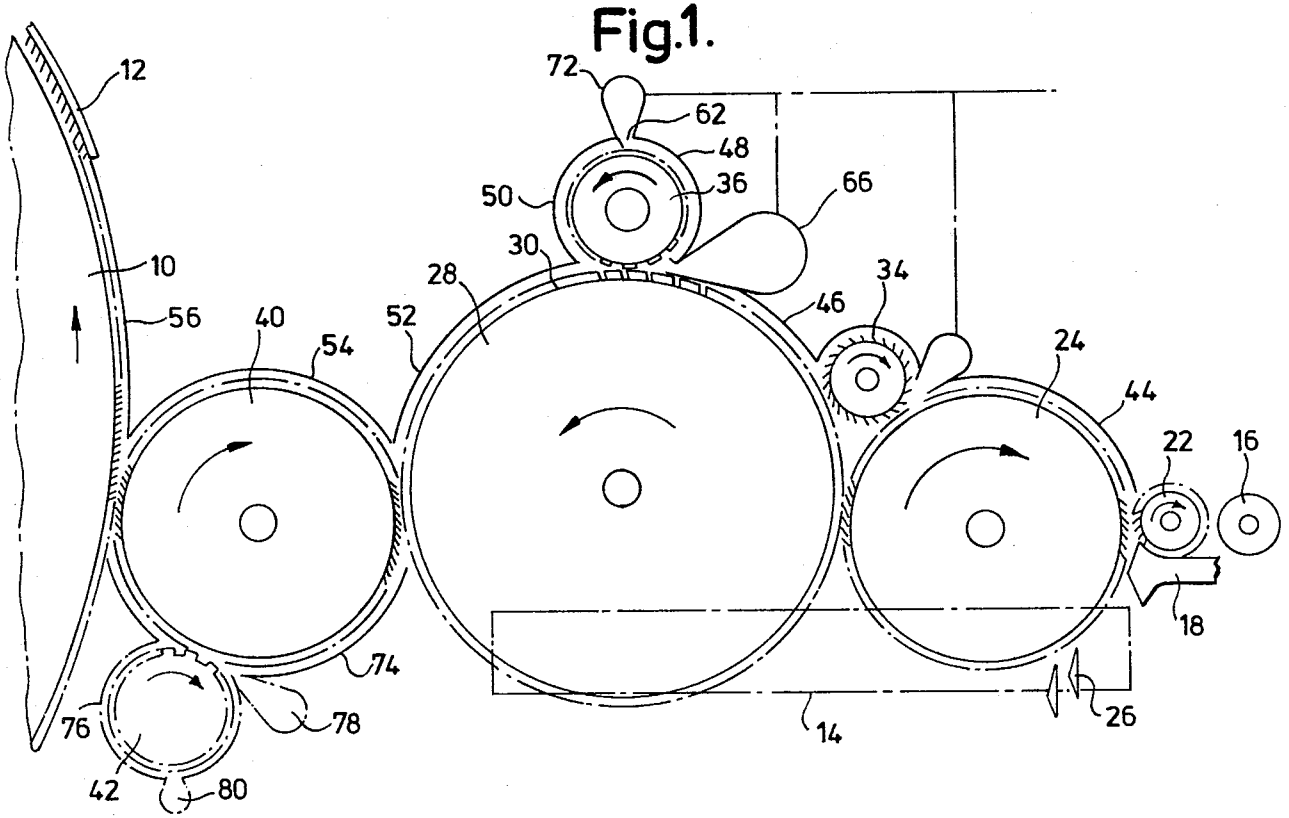

This is a continuation of application Ser. No. 869,297, filed Jan. 13, 1978, now abandoned.

Besides the primary function of opening and parallelising the fibres, one of the objectives of the carding process is the removal of trash to produce a sliver which is as clean as possible. In cotton, the trash generally comprises vegetable matter, dirt or small hard neps formed by entangled fibres. In man-made fibres the trash generally comprises fused fibres and chips of the fibrous material. Some of the trash is present in the material fed to the carding machine or in the sliver which emerges from the carding machine as "micro-dust" which can be broadly defined as dust having a particle size such that it can pass through filter screens.

The need for clean sliver has increased with the advent and development of the open-ended spinning process, because trash particles tend to block the grooves in the rotor of an open-end spinner and this increases the frequency of yarn breaks, which reduces the operating efficiency. The present invention is concerned with the removal of trash particles and micro-dust from fibrous material in a carding process (and particularly in the carding of cotton and man-made fibres).

According to one aspect of the invention, in carding textile fibres comprising cotton, man-made fibres, or a mixture in which cotton or man-made fibres predominates, the fibres are subjected to the cleaning action of a trash removing device mechanically co-operating with flat-topped card-clothing (as herein defined) on a roller. Preferably the flat-topped card-clothed roller is a taker-in roller located in a section of the machine where fibrous material is fed towards a main carding cylinder. It is also preferred that the taker-in is positioned in the initial opening zone, between the feed where the fibres are still in an uncarded form, and the position where the fibres are presented to a main carding cylinder. (The expression "flat-topped card-clothing" is used herein to describe card-clothing having teeth formed with a flat top—i.e. without substantial top rake, that is to say, teeth having a back point angle (I.S.O./DIS 5234) measured from the point of the tooth of not more than 20° and preferably not more than 15°—although after application to a roller, the tops of the teeth may be slightly arcuate by grinding. Preferably the back point angle is 0°.)

In the preferred method, the fibres being fed are pulled into the teeth of the flat-topped card-clothed roller before being subjected to the action of the trash removing device. This may be effected by the action of a card-clothed roller or a brush roller which on the one hand co-operates with the flat-topped card-clothed roller and on the other hand co-operates with the means feeding that roller.

The fibres may be pulled into the teeth of a flat-topped card-clothed taker-in roller by a card-clothed first taker-in roller which itself co-operates with a fibre feed system (such as a feed plate) after the fashion of a conventional taker-in, the taker-in with the flat topped teeth having point-to-point carding action with the teeth of the first taker-in.

The trash removing device may be a roller which removes trash protruding above the teeth on the flat-topped card-clothed roller.

The cleaning action may take place at two or more positions in the zone between the feed and the main carding cylinder.

According to another aspect of the invention, a flat type carding machine (as hereinafter defined) is provided with a trash removing device co-operating mechanically with a roller clothed with flat-topped card-clothing. Preferably the flat-topped card-clothed roller is a taker-in roller located in a section of the machine where the fibrous material is fed towards a main carding cylinder. It is also preferred that the taker-in is in the initial opening zone between the fibre feed device and a main cylinder. The expression "flat type carding machine" is used herein to describe machines having the well known revolving flats, or stationary flats or stationary plates covered on the side facing the main carding cylinder with card-clothing or other carding media.

Preferably the trash removing device comprises a fluted roller and it is preferred that its direction of rotation is the same as that of the taker-in, and that it is set close to (say within 0.010 inches of) the flat-topped card-clothed roller so that it is adapted to remove trash protruding above the teeth of the flat-topped card-clothed roller.

In the preferred arrangement, the flutes of the fluted roller provide sharp leading edges on the fluted roller. The flutes may be parallel with the axis of the fluted roller or slightly helical.

According to another preferred feature of the invention a roller is provided for pulling the fibres into the teeth of the flat-topped card-clothed roller. The roller for pulling the fibres into the teeth of the flat-topped card-clothed roller may comprise a card-clothed divider roller set just clear of the teeth on the flat-topped card-clothed roller and having a point-to-point co-operation therewith. Alternatively a brush roller may be provided for this purpose.

It is also preferred to provide a driving mechanism which causes the surface of the flat-topped card-clothed roller to travel upwardly at the position where the fibrous material is received on that roller, the trash removing device being positioned above the flat-topped card-clothed roller. The surface of a conventional taker-in as used in a flat type carding machine travels in a downward direction at the position where it receives fibrous material from the feed, and consequently, any co-operating devices such as mote knives have to be on the underside. A trash removing device such as the fluted roller positioned above the taker-in is more accessible than one positioned on the underside. However, it is also preferred to provide a transfer roller between the taker-in and the main cylinder for carrying the fibrous material to the main cylinder. The transfer roller may itself be card-clothed, in which case, its teeth are preferably so inclined and its speed of rotation such that there is a stripping (i.e. point-to-back-of-point) action between the transfer roller and the taker-in, and a further stripping action between the transfer roller and the main cylinder. It may be desirable to provide mote knives or other trash removing apparatus to operate in co-operation with the transfer roller, and in one arrangement, the transfer roller is clothed with flat-topped card-clothing and a fluted trash removing roller co-operates with it.

According to a further preferred feature, a cover plate is provided enclosing that part of the flat-topped card-clothed roller between the position at which fibrous material is fed to that roller and the trash removing device. It is desirable to prevent trash being carried around with the trash removing roller, and in as much as that roller rotates at a relatively high speed, it is preferable to reduce or control the creation of air currents by the roller. To this end, it is preferred to provide a cowling enclosing that part of the periphery of the trash removing roller which would otherwise be exposed.

Preferably the fluted roller is partly enclosed by a cover which is spaced radially from the periphery of the roller, there being a radial lip along one axially extending end of the cover substantially closing the radially disposed gap between that end of the cover and the roller. Preferably the lip comprises an inturned end of the cover. If no cover were provided, the fluted roller would create an air current which could have a deleterious effect on the trash removing operation and on the fibres in the teeth of the taker-in. It is known to enclose rollers in carding machines with covers to mitigate the effect of air currents, but it would be very difficult to provide such a cover which would fit close enough to the fluted roller, particularly on wide cards (i.e. carding machines of over 40 inches effective width). This problem is overcome by the use of a cover which although spaced radially from the fluted roller, has the radial lip at the axial end adjacent to the position where the surface of the fluted roller leaves the line of co-operation with the taker-in.

Preferably there is a small gap between the cover plate on the flat-topped card-clothed roller and the cover on the trash removing roller so that trash struck off the flat-topped card-clothed roller surface by the trash removing roller can escape through this gap. A trash collecting tray or suction duct may be adapted to receive material ejected from the flat-topped card-clothed roller through this gap.

The cowling enclosing the trash removing roller may have a gap in it part way around that part of the roller which would be exposed, a deflector lip on one side of the cover projecting into this gap so as to deflect material travelling in the space between the roller and the cover out through the gap.

Figure 2:
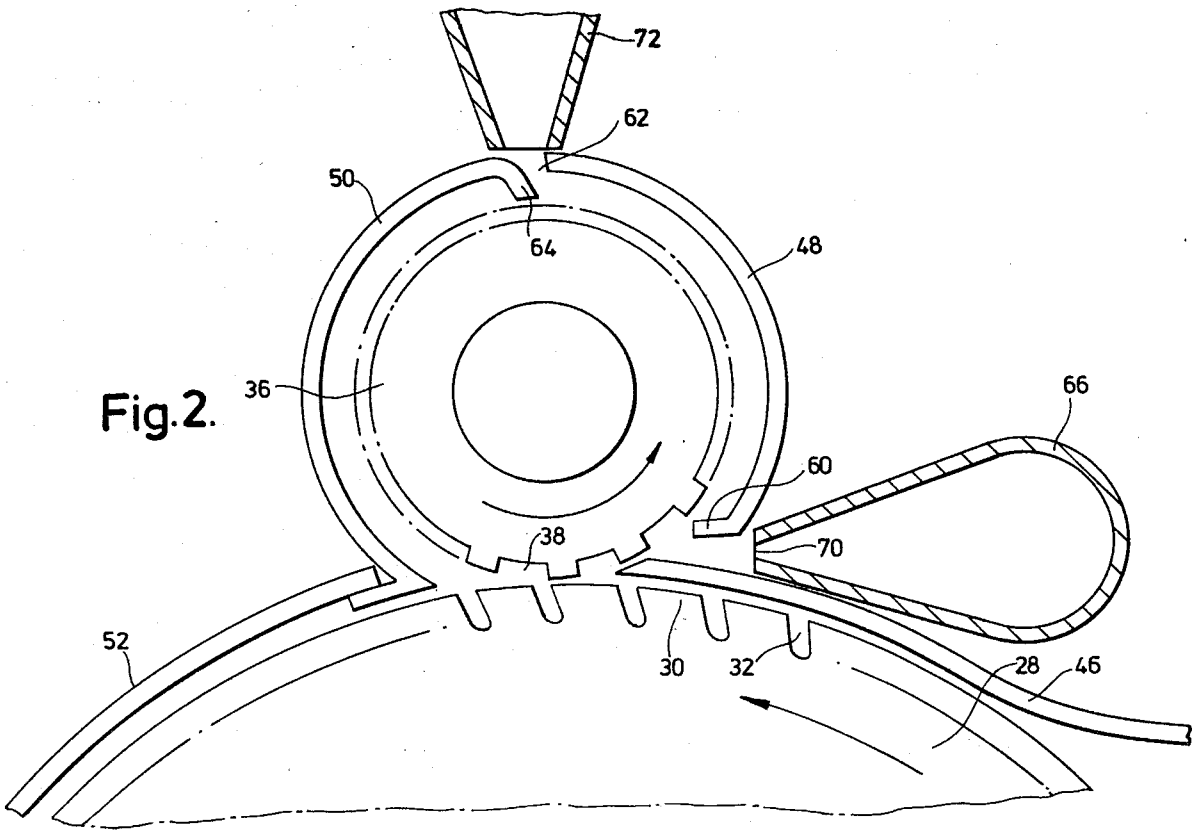
Figure 3:
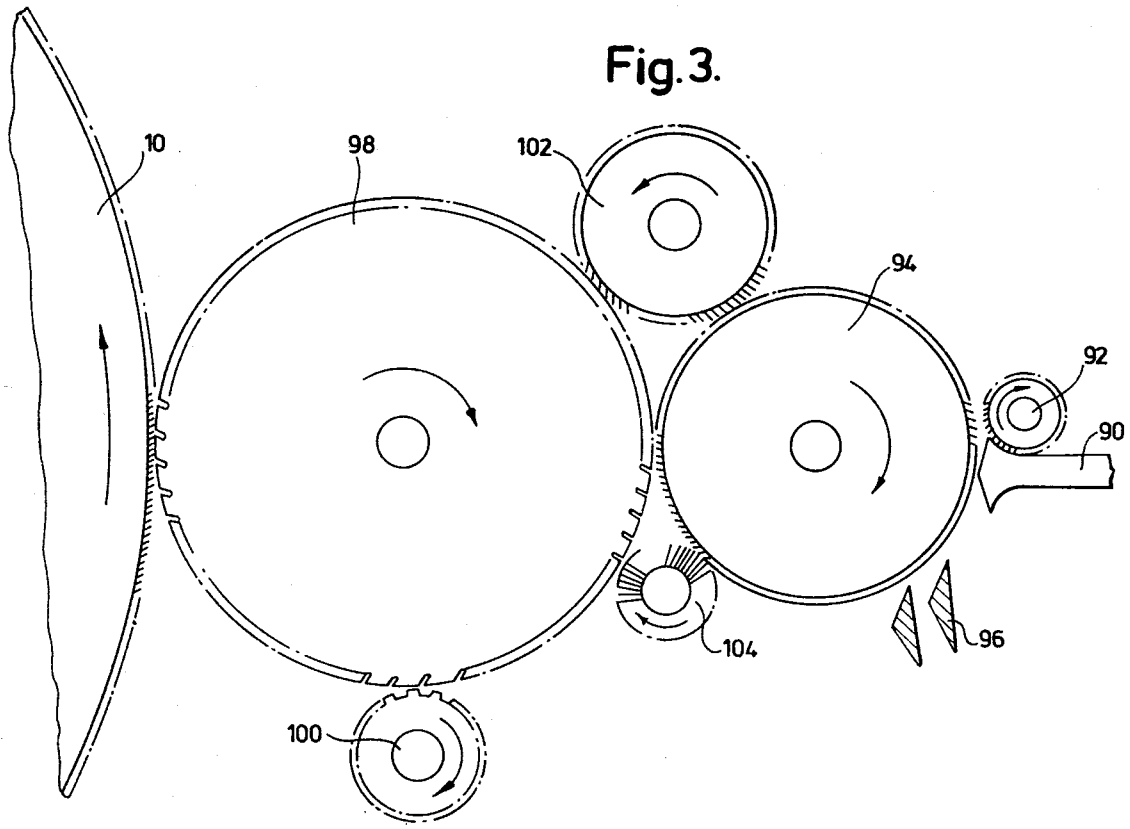
Figure 4:
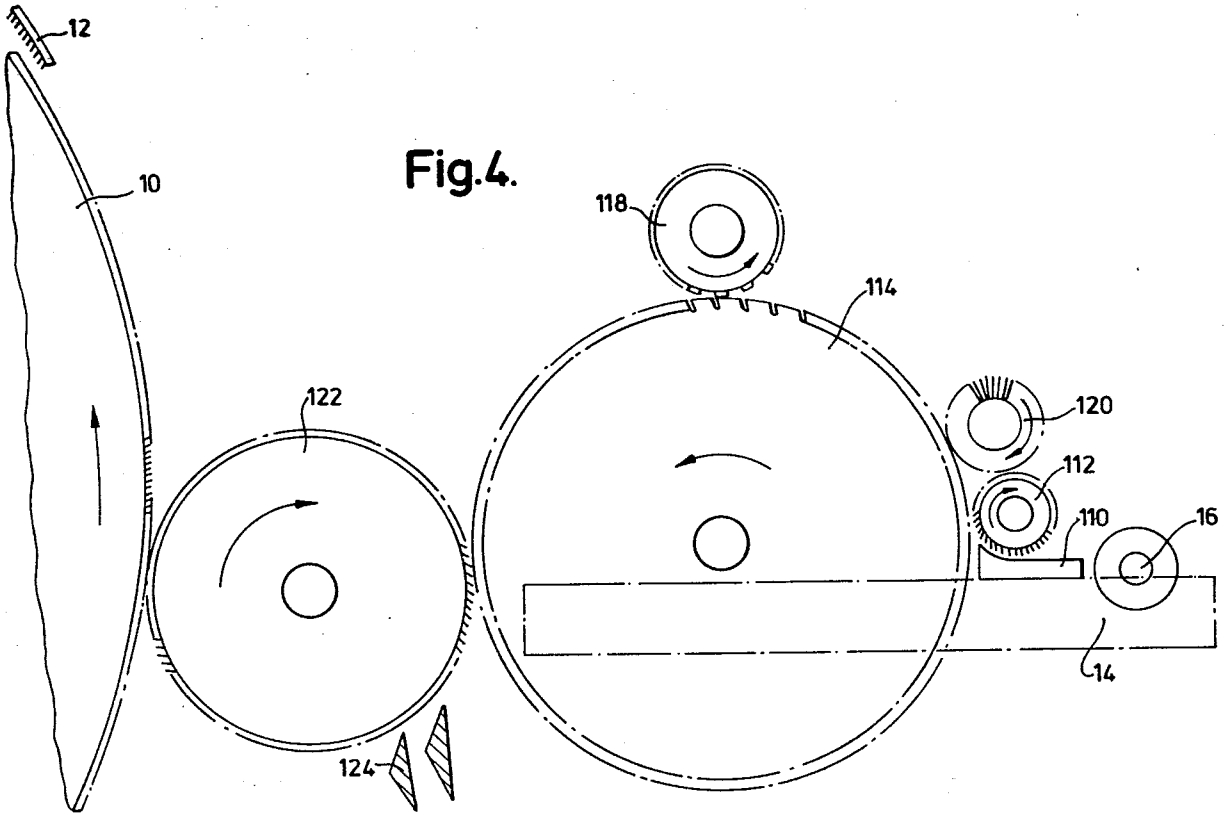
Figure 6:
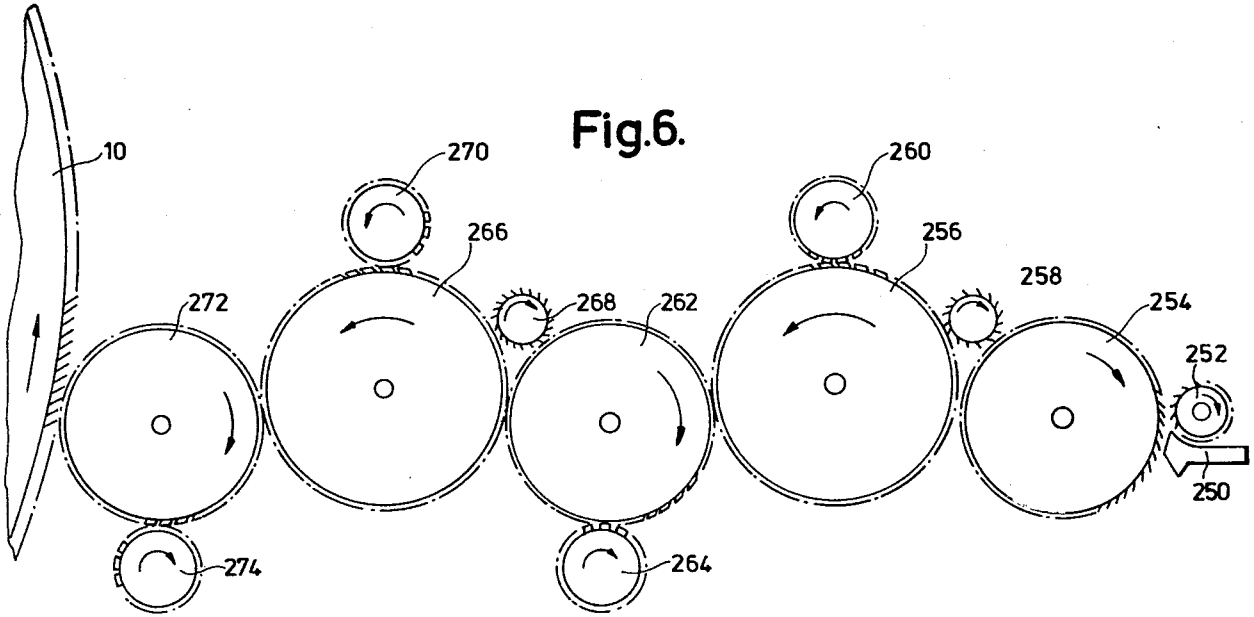
Figure 7:
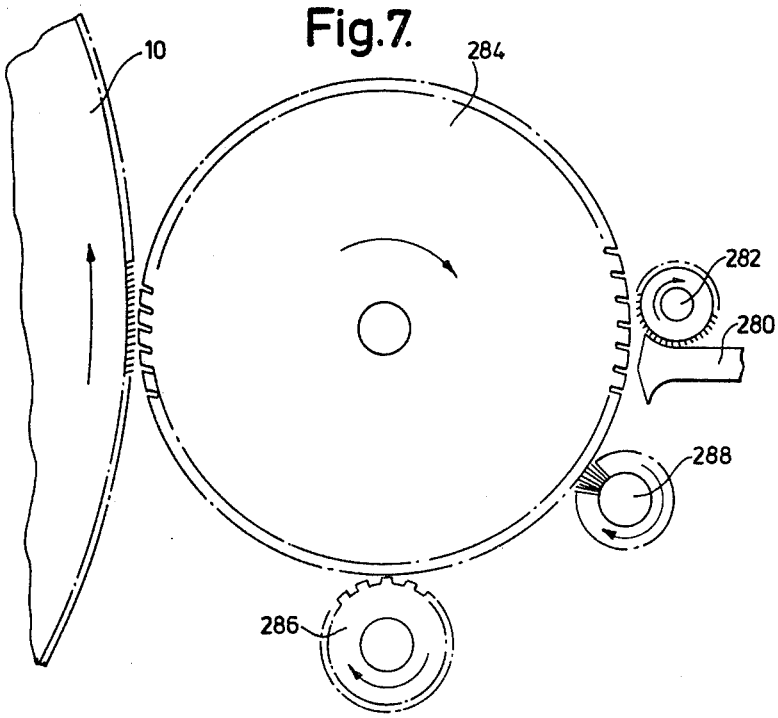
Figure 8:
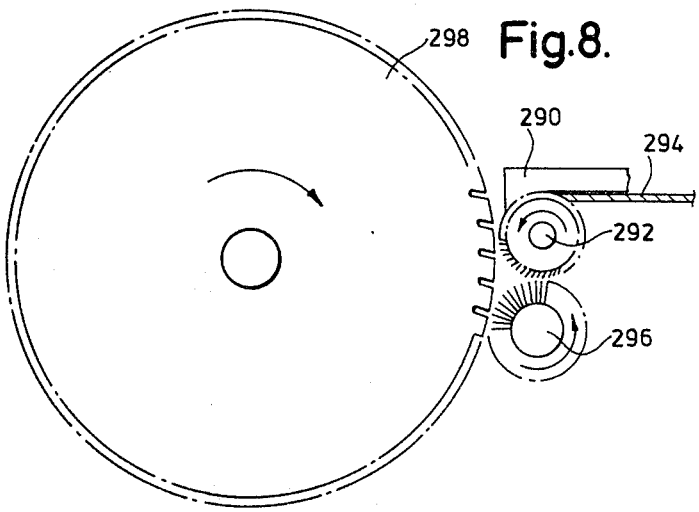
Figure 9:
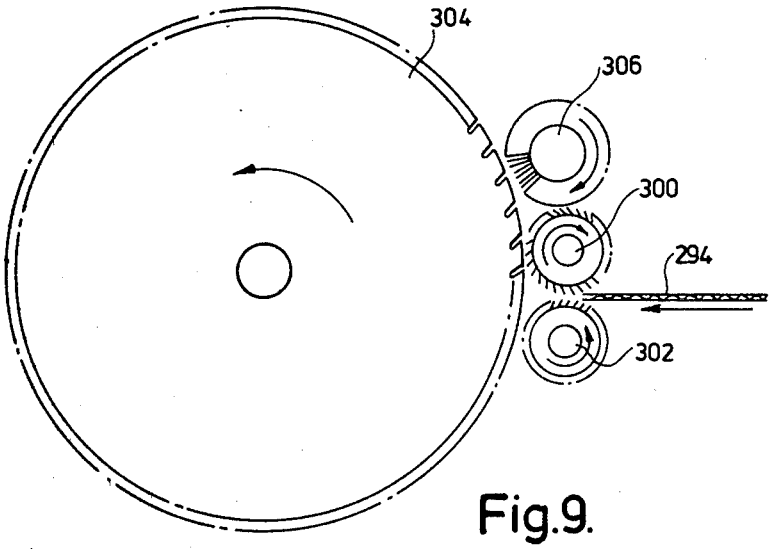
Figure 10:
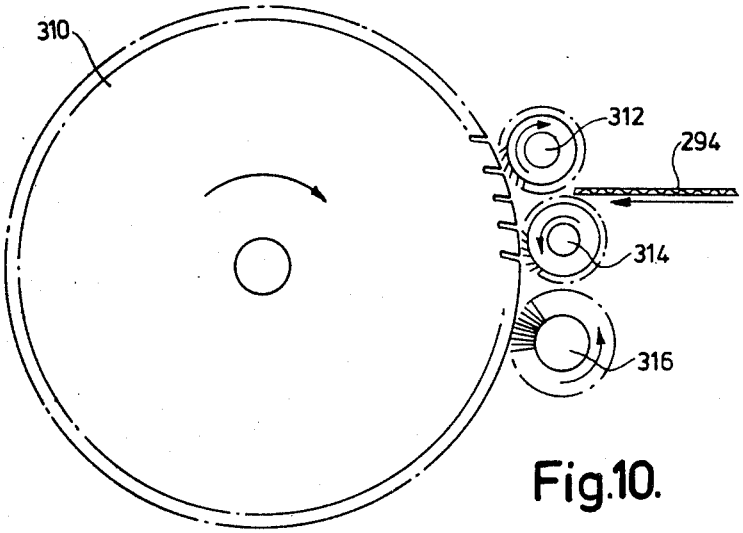

The invention in all its aspects will be better understood from the following description of various carding machine sections, which are given here by way of examples only, with reference to the accompanying drawings, in which:

FIG. 1 is a diagrammatic side view of the feed section of a carding machine incorporating the invention, FIG. 2 is a detail sectional view, to a larger scale of part of a taker-in and fluted roller, together with a cover arrangement, FIGS. 3 to 7 are views similar to FIG. 1, but showing alternative arrangements, FIG. 8 is a diagrammatic side view of an alternative fibre feed mechanism, for use with any of the arrangements shown in FIGS. 1 to 3 and 5 to 7, FIG. 9 is a view similar to FIG. 8, but showing a further alternative fibre feed mechanism for use with the arrangement shown in FIG. 4 and, FIG. 10 is a view similar to FIG. 8, but showing a further alternative fibre feed mechanism for use with any of the arrangements shown in FIGS. 1 to 3 and 5 to 7.

It is unnecessary to illustrate or describe the entire carding machine, because in many respects it is a conventional cotton type carding machine, and in particular, it has the usual card-clothed main cylinder 10 (see FIGS. 1, 3, 4, 5, 6 and 7) which in this instance is nominal 50 inches in diameter and 40 inches effective width. Certain dimensions are quoted in the specific example, but it is to be understood that these are not limitative, but are quoted to illustrate the specific constructions. In fact, it is likely that the invention will be effective on wide carding machines. Each of the various rollers described hereinafter rotates in the direction which is indicated by an arrow on that roller in the drawings.

Stationary arcuate carding plates, one of which is visible at 12 in FIG. 1, are provided around the upper part of the periphery of the cylinder 10, and these plates are card-clothed on their concave surfaces for co-operation with the cylinder so that the main carding action of the machine takes place between the cylinder and the plates 12. Of course, there could be a set of revolving flats instead of the stationary plates. Beyond the cylinder, there is the usual doffer (not shown) and web doffing arrangement, or the doffer may transfer the web to a second cylinder. Although the machine may be used for carding any kind of fibrous material, it is particularly suited to the carding of cotton fibres, man-made fibres, or blends containing at least 50% cotton or man-made fibres, and it can be described as a cotton or flat type carding machine, because it employs flats co-operating with the cylinder as distinct from a woollen or worker and stripper type card.

Referring now to FIGS. 1 and 2, a feed section is mounted on the side frame members of the machine (not shown) by side beams 14 which are constructed from square cross-section steel tube of substantial proportions. At the rear end, there is a conventional lap roller which rotates on its own axis and a bearing arrangement (not shown) for the reception of a lap spindle. The lap rests on the roller 16, and is fed in known manner from the lap roller to a feed plate 18. At its front end, the feed plate has the usual upturned nose, arcuate on the top side and is pointed in front as seen in cross-section.

A 2½ inches nominal diameter feed roller 22 is provided and set very close to the arcuate top surface of the feed plate 18 which surface is curved about the axis of the feed roller. This is the conventional position for the feed roller and it has metallic card-clothing pointing in the opposite direction to its direction of rotation. It is possible to employ a longitudinally fluted feed roller instead of a card-clothed feed roller. The actual speed of rotation of the feed roller is quite low, and is related to the speed of the doffer in the conventional manner.

A conventional downstroke taker-in roller 24 co-operates with the feed plate 18 and feed roller 22, and has metallic wire type card-clothing, and plucks off fibrous material fed between the feed plate and the feed roller, and carries it forward in the machine. In FIG. 1, the taker-in 24 is shown co-operating with a pair of mote knives 26, but it is to be understood that these are optional and may not be required. However, the taker-in 24 has the usual rough opening effect of a taker-in.

A second taker-in roller 28 is journalled in bearings mounted on the beams 14, and driven so that it rotates in the opposite direction to the first taker-in 24. The second taker-in is larger than the first in this particular example and rotates to give a surface speed higher than that of the first taker-in 24. The second taker-in is clothed with a metallic wire type card-clothing which as shown in FIG. 2, has relatively wide flat topped teeth 30 with only narrow spaces 32 between successive teeth. It will be appreciated that although the wire will have flat-topped teeth when in the straight condition (i.e. as manufactured), after it has been wound on to the taker-in 28 and then ground on its periphery, its tops receive a very slight arcuate form following a radius of the roller.

It is a significant feature of the arrangement that the teeth 30 are flat-topped, (as previously defined) but it is not essential that it should be of the specific form shown in FIG. 2. The flat tops of the teeth may be shorter, particularly if the back angle of each tooth is more acute than that illustrated (so that the gaps between the teeth are not parallel sided).

Although the action between the first and second taker-in rollers should result in stripping of the first taker-in 24 by the second taker-in 28, the fibres may not be drawn deep into the teeth 30, because of the flat tops of those teeth; but it is desirable to draw the fibres into the teeth 30 as will hereinafter appear. A divider roller 34 is mounted in the top angle between the first and second taker-in rollers and provided with ordinary pointed metallic wire type card-clothing. The teeth of the divider roller 34 point in the opposite direction to the direction of rotation of that roller and the divider roller is set with its teeth only just clear of the teeth on the two taker-in rollers. The divider roller rotates at a slower speed than the taker-in roller 24 and hence there is a carding or point-to-point action between the divider roller 34 and the second taker-in roller 28, and a stripping action between the first taker-in roller 24 and the divider roller 34. The first of these actions pulls the fibres on the second taker-in 28 into the teeth on that roller and the second action removes any fibres pulled off the second taker-in by the divider roller 34 and puts them back on the first taker-in 24, ready to be presented by that roller to the second taker-in. The divider roller 34 could be replaced by a brush roller, with its bristles set into the teeth on the second taker-in roller 28, but although a brush roller might satisfactorily pull most of the fibres into the teeth on the second taker-in roller, it would not function as effectively as a card-clothed roller to remove the fibres resting on the tops of the teeth of the second taker-in and replace them on the first taker-in. Therefore, the card-clothed divider roller 34 is preferred to a brush roller.

Above the second taker-in 28 there is a fluted roller 36 with an axially slotted periphery (see FIG. 2), the flutes providing sharp leading edges on the lands of the roller and this roller is set so that the lands pass within say 0.005 inches of the flat tops of the teeth on the second taker-in 28. In this particular construction the slots or flutes 38 are of rectangular cross-section and extend parallel with the axis of the fluted roller, but in some instances, the flutes may be helically arranged with respect to the fluted roller. The fluted roller 36 is rotated at a high surface speed (for example, if the roller is 4 inches in diameter, it may be rotated at a speed of over 1000 r.p.m.) and it will be noted that it rotates in the same direction as the taker-in, so that at the zone of co-operation between those two rollers, their surfaces are travelling in opposite directions.

As a result of the action between the first and second taker-in rollers and the action of the divider roller 34, the majority of the fibres on the second taker-in are pulled to its teeth, but a large proportion of the impurities in the fibre including "trash" remain on the tops of the teeth 30.

The forwardly facing edges of the lands on the fluted roller 36 strike the "trash" and other impurities on the tops of the teeth of the taker-in 28, and this separates the impurities from the fibres and breaks down any larger lumps of foreign manner or knotted fibres and throws the separated material rearwardly from the zone of co-operation between the taker-in 28 and the fluted roller 36. It has been found that by removing a large proportion of the impurities contained in the fibrous material presented to the second taker-in 28, at this early stage in the carding machine, it is possible to improve significantly the overall cleaning action of the machine on the fibres being processed.

The precise manner in which the trash removing arrangement comprising the taker-in 28 and the fluted roller 36, cleans the fibrous material is not fully understood, and is not easily observable. It is likely that the action of breaking down or loosening the trash particles enables those particles to be more easily removed in the subsequent carding process on the cylinder 10 or by a crushing roller arrangement if such an arrangement is fitted after the doffer. However, the bulk of the trash material is apparently removed at the taker-in and fluted roller, because the card flats or carding plates are found to be relatively clean after a period of use.

A card-clothed transfer roller 40 is positioned between the second taker-in 28 and the main cylinder 10, this transfer roller also forming part of the feed section of the machine. In this instance, the transfer roller is about the same diameter as the first taker-in, and it is clothed with metallic wire type card-clothing. The teeth of the transfer roller point in the direction of rotation, and its surface speed is greater than that of the second taker-in so that it has a stripping action from the taker-in. The transfer roller co-operates with the main cylinder 10 in the same manner as a conventional taker-in, that is to say, the main cylinder has a stripping action from the transfer roller.

If the transfer roller 40 is clothed with pointed card-clothing, then it may act simply as a means of carrying the fibrous material from the second taker-in to the cylinder 10. However, mote knives (not shown) may be positioned beneath the transfer roller to perform an additional cleaning operation. Alternatively, the transfer roller may be covered with flat-topped card-clothing similar to that on the taker-in 28, in which case a further fluted roller, indicated in chain-dotted lines at 42, may be provided on the underside of the transfer roller. This fluted roller, if fitted, carries out a cleaning action similar to that which occurs between the rollers 28 and 36, before the fibrous material passes on to the cylinder 10. Other trash removing devices such as are known for use under a taker-in may be provided under the transfer roller 40 in addition to or as an alternative to more knives or the fluted roller 42.

It is usual to enclose the surfaces of the card-clothed rollers over which the fibrous material travels by stationary cover, which exercise a controlling effect on the air currents generated by the rotation of the various rollers. A first back cover 44 fits slightly clear of the teeth of the first taker-in 24 and extends between the feed roller 22 and the divider roller 34. A second back cover 46 extends around the top of the divider roller 34, and over the part of the second taker-in between the divider roller and the zone of co-operation between the second taker-in and the fluted trash removing roller 36. The front end of the cover plate 46 is set as close as practicable to the nip between the second taker-in 28 and the fluted roller 36.

The fluted trash removing roller 36 is enclosed in a cowling comprising a rear cover 48 and a front cover 50, there being a radial gap of say ¼ of an inch between the covers 48 and 50 and the fluted roller 36, and an inturned lip 60 being provided at the rear end of the cover 48. There is a short gap 62 less than ¼ of an inch wide between the covers 48 and 50, and as is clear in FIG. 2, the rear end of the cover 50 has a deflector lip 64 which extends across the front side of this gap and is only just clear of the teeth on the trash removing roller 36. A series of covers 52, 54 and 56 is provided to cover the exposed portions of the surfaces of the second taker-in 28, the transfer roller 40 and the main cylinder 10.

One purpose of the cowling 48 and 50 is to minimise the creation of air currents by the fluted roller 36, and especially to minimise the intake of an airsteam at the rear of that roller. When covers are fitted over carding rollers for this purpose, it is usual to fit them as close as possible to the roller. It is difficult to locate a cover close enough to the fluted roller throughout its length, and this problem becomes more acute on wide carding machines. However, it is possible to arrange for the lip 60 to be an adequately close fit to the periphery of the fluted roller, and hence this problem is solved by setting the covers 48 and 50 away from the periphery of the roller by the ¼ of an inch gap, and providing the inturned lip 60 at the rear end.

It will be appreciated that some trash tends to be thrown out by the roller 36 at the gap between the cover 46 on the taker-in 28 and the cover 48 on the roller 36. A suction cowling 66 has its inlet opening 70 pointing towards this gap, the suction cowling being connected to a suction system (not shown) such as the frequently fitted to carding machines. Thus the trash thrown out at the rear of the roller 36 is immediately removed by the suction system. As an alternative to the suction cowling, there may be a trash collection tray formed on the cover 46. However such collection trays have to be periodically cleaned by an operative.

Further trash released by the roller 36 travels around that roller until it encounters the deflector lip 64 which deflects the trash outwardly through the gap 62. A suction cowling 72 also connected to the suction system has its inlet opening facing the gap 62, and hence the trash thrown out at this position is also sucked away. It has been observed that this arrangement removes a significant part of the micro-dust present in the fibrous material.

If a trash removing roller 42 is provided, then a cover 74 extends around the underside of the transfer roller 40, and there is a cowling 76 and suction cowling 78 and 80 similar to those provided for the trash removing roller 36.

The complete feed section from the lap roller 16 to the transfer roller 40 may be built into a new carding machine, or it may be constructed as a unit which can be used to replace the conventional feed section of an existing carding machine.

Referring now to FIG. 3, there is shown an alternative construction of feed section for a carding machine, in which there is a feed plate 90 with a co-operating card-clothed feed roller 92 and a conventional first taker-in roller 94, which is also card-clothed, and which rotates in a clockwise direction as seen in the drawing. At the zone of co-operation between the feed plate 90 and the taker-in 94, the latter plucks fibres from the feed plate and carries the fibres downwardly. A set of mote knives 96 is provided beneath the taker-in 94 and these carry out a first cleaning action on the fibres carried by the first taker-in. Up to this point, the arrangement is entirely conventional.

A second taker-in roller 98 is provided between the first taker-in 94 and the main carding cylinder 10, this second taker-in being clothed with flat card-clothing as described with reference to the taker-in 28 shown in FIG. 1, and rotating in the same direction as the first taker-in 94, but at a higher surface speed. The second taker-in roller 98 carries the fibres downwardly and is then stripped by the main carding cylinder 10.

A fluted trash removing roller 100 is provided and this is constructed in similar fashion to the fluted roller 36 described with reference to FIGS. 1 and 2, and co-operates mechanically with the second taker-in roller 98, in the same manner as the roller 36, excepting that it is positioned beneath the roller 98. It will be appreciated, that whereas with an upstroke second taker-in, such as that illustrated in FIG. 1, the fluted roller 36 can be mounted above the taker-in, with a downstroke second taker-in as that which is shown at 98 in FIG. 3, it becomes necessary to mount the fluted roller 100 below the taker-in. However, the fluted roller 100 has exactly the same trash removing function as the roller 36.

In this arrangement, a transfer roller 102 is provided in the top angle between the two taker-in rollers 94 and 98, and this roller is covered with ordinary metallic wire type card-clothing and rotated in the opposite direction to the taker-in rollers. The main purpose of the transfer roller is to transfer fibrous material from the first taker-in 94 to the second taker-in 98. The roller 98 itself has a stripping action on the transfer roller 102.

A brush roller 104 is also provided for pressing the fibres into the teeth of the second taker-in roller 98, the brush being set clear of the teeth on the first taker-in roller 94, so that it co-operates only with the second taker-in roller 98. A divider roller similar to the divider roller 34 shown in FIG. 1 may be used in place of the brush roller 104.

Covers (not shown) are fitted under and over the rollers of the feed section shown in FIG. 3, and the cover and suction arrangement for the trash removing roller 100 is the same as that described with reference to the roller 36 shown in FIGS. 1 and 2. In fact, in the following examples where-ever a trash removing roller co-operates with a flat topped card-clothed taker-in roller, it is to be understood that a cover arrangement similar to that shown in FIGS. 1 and 2 is fitted. In view of the diagrammatic nature of the drawings however, these covers are only illustrated in FIGS. 1 and 2.

It will be appreciated that the action of the feed section shown in FIG. 3 is very similar to that of the feed section described with reference to FIGS. 1 and 2.

FIG. 4 illustrates another feed section in which there is a feed plate 110, feed roller 112, and upstroke taker-in roller 114. It is to be noted that the front end of the feed plate 110 is not pointed as is usual, but is vertical. Because of this, the feed roller 112 projects slightly in front of the front face of the feed plate. With this arrangement, the tufts of fibres are pulled into the teeth of the taker-in 114 by the teeth on the feed roller 112 and the taker-in then carries the fibres upwardly. There is a carding action on the fibres and this is achieved by the point-to-point action between the feed roller 112 and the taker-in 114.

The taker-in 114 has flat topped teeth, and a fluted trash removing roller 118 mounted above the taker-in roller 114 co-operates with that roller in exactly the same manner as the fluted roller 36 described with reference to FIGS. 1 and 2, and there is a brush roller 120 in the angle between the feed roller 112 and the taker-in 114. Since the taker-in 114 operates on the same upstroke principle, a transfer roller 122 similar to the transfer roller 40 shown in FIG. 1, is needed to carry the fibres from the taker-in 114 to the main carding cylinder 10. In FIG. 4, mote knives 124 are shown co-operating with the transfer roller 122, but it will be appreciated that a second fluted roller could be provided similar to that shown at 42 in FIG. 1. In fact, the basic difference from the arrangement shown in FIG. 1, is the omission of the first taker-in 24 between the feed plate and the flat topped card-clothed taker-in.

Figure 5:
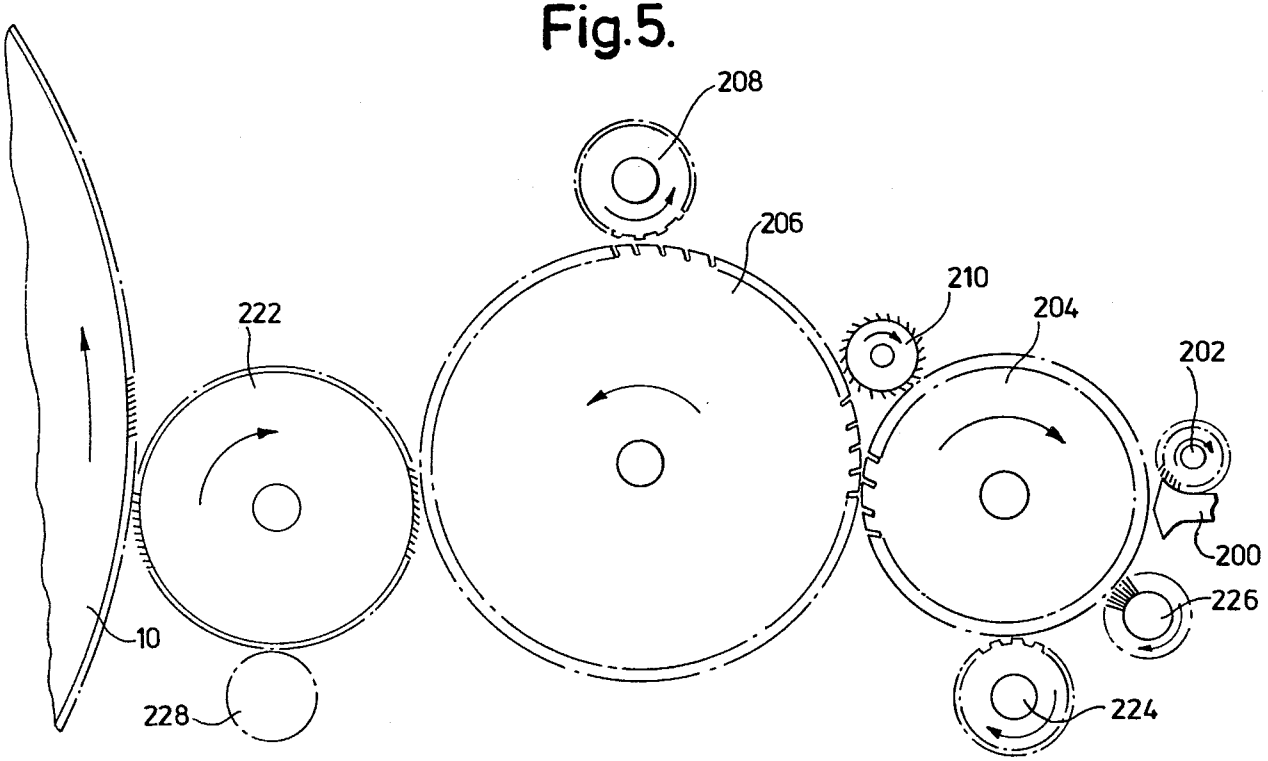

FIG. 5 illustrates a refinement of the invention, which provides for two or three cleaning actions of the kind produced by the action of a fluted trash removing roller on a flat topped toothed roller, thus increasing the cleaning action on the fibres. The roller arrangement is similar to that shown in FIG. 1 comprising:

Feed plate 200; feed roller 202; first taker-in 204; second taker-in 206; fluted roller 208; divider roller 210 and transfer roller 222. In this particular arrangement however, the first taker-in roller 204 is covered with the flat topped metallic card-clothing, similar to that employed on the roller 28, and there is a fluted roller 224 similar to the roller 36 co-operating with the underside of the taker-in roller 204. There is also a brush roller 226 on the underside of the taker-in 204 between the feed plate 200 and the fluted roller 224. A third fluted roller 228 may be provided under the transfer roller 222 if that roller is covered with flat topped card-clothing.

The action of this feed arrangement is as follows:

The first taker-in 204 removes fibres from the feed plate 200; the brush roller 226 presses the fibres into the teeth on the taker-in roller 204; there is a cleaning action between the fluted roller 224 and the taker-in 204; there is a stripping action between the two taker-in rollers; the divider roller 210 presses the fibres into the teeth of the second taker-in roller 206; there is a second cleaning action between the second taker-in roller 206 and the fluted roller 208, and finally, the transfer roller 222 strips the second taker-in roller 206 and carries the fibres on to the main carding cylinder 10.

FIG. 6 illustrates a sophisticated form of the invention intended to have a very effective cleaning action on the fibrous material before the latter is fed to the carding cylinder 10. At the rear end, there is the conventional arrangement of feed plate 250, feed roller 253 and downstroke taker-in roller 254, the latter having pointed metallic wire type card-clothing.

This is followed by a section comprising a second taker-in roller 256, divider roller 258, trash removing fluted roller 260 and transfer roller 263 all of which are identical with the corresponding rollers shown in FIG. 1, and there is a second fluted roller 264 co-operating with the transfer roller 262.

A further cleaning section follows, comprising a third taker-in roller 266, divider roller 268, fluted roller 270, transfer roller 272 and fluted roller 274, which again is identical with the arrangement shown in FIG. 1, the transfer roller 262 presenting the fibrous material to the third taker-in 266. Since there are four trash removal fluted rollers 260, 264, 270 and 274 the total cleaning is very efficient.

Turning now to FIG. 7, there is shown perhaps the most elementary form of the invention, in which there is the conventional feed plate 280 with a card-clothed feed roller 282 and a single taker-in roller 284 working on the downstroke principle, so that it strips fibres from the feed plate and co-operates directly with the main carding cylinder 10.

The taker-in roller 284 has the flat-topped card-clothing previously described, and a fluted roller 286 similar to the roller 36 of FIGS. 1 and 2 co-operates with the taker-in 284 on the underside thereof. There is also a brush roller pulling the fibres into the teeth of the roller 284 between the feed plate 280 and the fluted roller 286.

In this simplified form of the invention, the only differences from a conventional feed section of a carding machine are the provision of the flat topped teeth on the taker-in and the provision of the fluted roller 286 and the brush roller 288.

All the arrangements so far described have made use of a feed plate and card-clothed feed roller and these are generally conventional (except that where an upstroke taker-in co-operates with the feed plate as illustrated in the FIG. 4 arrangement, the teeth of the feed roller 112 are set very close to those of the taker-in to produce a carding action). FIG. 8 illustrates another arrangement which can be used with any of the downstroke taker-in rollers. Here, a feed plate 290 is inverted, and its feed roller 292 is mounted under the plate. The fibrous material is nipped between the feed roller 292 and the underside of the feed plate 290. With this arrangement, the teeth of the feed roller 292 are set close to those of a taker-in 298 so that there is a carding action between these two rollers as is the case between the upstroke taker-in 114 and the feed roller 112 shown in FIG. 4. Also, a brush roller 296 is set just clear of the teeth on the taker-in and just clear of the teeth of the feed roller 292, as with the arrangement described with reference to FIG. 4, so that in addition to pulling the fibres into the teeth of the taker-in roller 298, if any fibres are carried on the feed roller passed the zone of co-operation with the taker-in roller, they are stripped by the brush roller and carried on to the taker-in roller.

It is not essential to employ a feed plate and feed roller system. Instead, there may be a pair of card-clothed feed rollers 300 and 302 (see FIG. 9) rotating in opposite directions close to each other, so that fibrous material is fed through their "nip" directly to an upstroke taker-in roller 304 of the type described with reference to FIG. 4. In such a case, a brush roller 306 is set just clear of the taker-in roller and just clear of the top feed roller 300, so that it co-operates with the rollers 304 and 306 in similar fashion to the brush roller 120 described with reference to FIG. 4.

FIG. 10 illustrates an alternative feed system when a downstream taker-in 310 is employed. In this case, a pair of feed rollers 312 and 314 similar to the rollers 300 and 302 is provided, but the brush roller 316 is mounted below these rollers to co-operate with the taker-in 310 and the bottom feed roller 314.

In all the examples illustrated in the drawings, the cleaning action takes place in the initial opening zone of the machine between the position where the fibres are still in an uncarded form and the position where the fibres are presented to the main carding cylinder. It will be appreciated that in the case of a carding maching having more than one main carding cylinder (e.g. the so-called tandem card) the feed section to the second or subsequent carding cylinder can be modified to incorporate a flat-topped card-clothed taker-in roller and co-operating trash removing roller arrangement in accordance with the invention and in particular as shown in any of FIGS. 1 to 7 of the drawings.

It is to be understood that the mechanical cleaning effect can be arranged to take place at any position in the carding machine, by providing a flat-topped card-clothed roller on which the fibrous material travels and a trash removing roller. For example, the flat-topped card-clothed roller could be arranged to receive fibrous material from the cylinder, there being an arrangement such as a stripping roller for replacing the material on the cylinder.

We claim:

1. A flat type carding machine which includes a roller with card-clothing having flat-topped teeth; a trash removing roller set close to said card-clothed roller and adapted to remove trash projecting above the teeth of said card-clothed roller; a trash deflector arranged close to the part of said card-clothed roller which is on the approach side to said trash removing roller, and having a trailing end close to said trash removing roller; a cowling enclosing at least the part of said trash removing roller which is moving away from said card-clothing roller, and having an inlet end close to said card-clothed roller, said cowling at least in the region adjacent said inlet end being spaced radially from the periphery of said trash removing roller; said cowling and said trailing end of said deflector defining an opening through which trash struck off said card-clothed roller can escape, and a suction nozzle arranged with its inlet closely adjacent to said opening for keeping said opening free from blockage, the arrangement of said deflector, said cowling and said suction nozzle substantially preventing trash travelling around with said trash removing roller.

2. A flat type carding machine according to claim 1, werein said carding machine has a main carding cylinder and said flat-topped card-clothed roller is a taker-in roller located in a section of said carding machine where fibrous material is fed towards said main carding cylinder.

3. A flat type carding machine according to claim 2, in which said taker-in is positioned in the initial opening zone of said carding machine between a fibre feed device and said main cylinder.

4. A flat type carding machine according to claim 2, in which a roller is provided for pulling fibres into the teeth of said flat-topped card-clothed roller.

5. A flat type carding machine according to claim 4, wherein a further card-clothing roller is positioned in advance of said taker-in roller for feeding fibrous material to said taker-in roller, and said roller for pulling fibres into the teeth of said taker-in roller is set in the angle between said further card-clothed roller and said taker-in roller, a first back cover extending over the further roller where it approaches said fibre pulling roller, and a second back cover extending over said fibre pulling roller, adjacent ends of said first back cover and said second back cover defining a further gap, and further suction means positioned to remove trash and dust from said further gap.

6. A flat type carding machine according to claim 2, in which a driving mechanism is provided which causes the surface of said flat-topped card-clothed taker-in roller to travel upwardly at the position where fibrous material is received on said taker-in roller; said trash removing device is positioned above said taker-in roller and there is provided a transfer roller between said taker-in roller and said main cylinder for carrying fibrous material to said main cylinder.

7. A flat type carding machine according to claim 1, in which said trash removing device is a roller set close to said flat-topped card-clothed roller whereby it is adapted to remove trash projecting above the teeth on said flat-topped card-clothed roller.

8. A flat type carding machine according to claim 1, in which said trash removing device comprises a fluted roller.

9. A flat type carding machine according to claim 8, in which the direction of rotation of said fluted roller is the same as that of said flat-topped card-clothed roller.

10. A flat type carding machine according to claim 8, in which the flutes of said fluted roller provide sharp leading edges on said fluted roller.

11. A flat type carding machine according to claim 1, in which said cowling substantially encloses the otherwise exposed surface of said trash removing roller and has a gap in it part-way around said cowling from said inlet end.

12. A flat type carding machine according to claim 11, further comprising a deflector lip projecting into said gap so as to deflect material travelling in the space between said trash removing roller and said cowling out through said gap.

13. A flat type carding machine as claimed in claim 12, having suction means for withdrawing trash out through said gap.

14. A flat type carding machine according to claim 1, further including a radially inturned lip along said inlet end of said cowling substantially closing the radially disposed gap between that end of said cowling and said trash removing roller, said opening being defined by said inturned lip and said trailing end of said deflector.

15. A method of carding cotton, man-made or a mixture of cotton and man-made textile fibres in a carding machine, comprising the steps of: feeding the fibres to a first roller having flat-topped card-clothing, whereby the fibres are carried forward on said first roller; subsequently pulling at least some of the fibres on the first roller into the flat-topped card-clothing thereon by means of a second card-clothed roller or a brush roller co-operating with the first roller at a position beyond that at which the fibres are fed to the first roller, having regard to the direction of motion of the first roller, whereby at least some of the trash carried by the fibres is left exposed on the flat tops of the flat-topped card-clothing; subjecting the exposed trash on the first roller to the action of a trash removing device co-operating with the first roller; removing the fibres from the first roller, and subjecting the fibers to a card action between a card-clothed cylinder and at least one card-clothed plate or flat.

16. A method of carding cotton, man-made or a mixture of cotton and man-made textile fibres in a carding machine, comprising the steps of: feeding the fibres onto a first roller having flat-topped card-clothing, whereby the fibres are carried forward on the first roller; subsequently pulling at least some of the fibres on the first roller into the flat-topped card-clothing therein by means of a second card-clothed roller or a brush roller co-operating with the first roller at a position beyond that at which the fibres are fed to the first roller, having regard to the direction of motion of the first roller, whereby at least some of the trash carried by said fibres is left exposed on the flat tops of the flat-topped card-clothing; subjecting the exposed trash to: (i) a breaking action between a beater roller and the card-clothing on the first roller; (ii) detachment from the fibres by the action between the beater roller and the card-clothing on the first roller; and (iii) suction, removing detached, broken and free trash and dust from the fibres on the first roller; removing the fibres from the first roller; and subjecting the fibres to a carding action between a card-clothed cylinder and at least one card-clothed plate or flat.

17. A method of carding cotton, man-made or a mixture or cotton and man-made textile fibres in a carding machine according to claim 16, wherein the detached trash is also struck off the card-clothing on the first roller by the beater roller, whereby said trash is free to be removed by suction.

18. A method of removing trash and dust from cotton fibres travelling on a roller clothed with flat-topped card-clothing comprising the steps of pulling the the fibres into the card-clothing and simultaneously leaving trash exposed on the flap tops of the card-clothing, whereby there is a substantial sorting of the fibres from the trash; beating the exposed trash to substantially completely detach it from the fibers and to break any relatively large lumps of the trash; and sucking the then free trash and dust from the card-clothing on the roller.

19. A flat type cotton carding machine having a card-clothed cylinder co-operating with at least one card-clothed flat, wherein there is also provided: a first roller clothed with card-clothing having flat-topped teeth and being located in advance of said cylinder; a trash removing device co-operating mechanically with said first roller, set close to said first roller and adapted to break and strike off trash exposed on the flat tops of the card-clothing teeth on said first roller; and roller means co-operating with said first roller, positioned in advance of said trash removing device, and adapted to pull fibres into the card-clothing on said first roller and to leave trash exposed on the flat tops of the teeth of the card-clothing on said first roller.

20. A flat type carding maching according to claim 19, wherein said trash removing device comprises a fluted roller.

21. A flat type carding machine according to claim 19, wherein a driving mechanism is provided which causes the surface of said flat-topped card-clothed first roller to travel upwardly at the position where fibrous material is received on said first roller; said trash removing device being positioned above said first roller and there being further provided a transfer roller between said first roller and said main cylinder for carrying fibrous material to said main cylinder.

22. A flat type cotton carding machine including: at its feed end, a roller clothed with card-clothing having flat-topped teeth; a trash removing device co-operating mechanically with said flat-topped card-clothed roller; roller means positioned in advance of said trash removing device for pulling cotton fibres into said flat-topped card-clothing sufficiently to permit said trash removing device to remove trash from the cotton fibres and loosen remaining debris in the cotton fibres; and a carding cylinder cooperating with at least one flat or carding plate for opening the cotton fibres and permitting removal of debris previously loosened by said trash removing device.

* * * * *